US006998965B1

(12) United States Patent
Luciano, Jr. et al.

(10) Patent No.: US 6,998,965 B1
(45) Date of Patent: Feb. 14, 2006

(54) ENHANCED GOLF RANGE PLAY USING RFID AND GPS

(75) Inventors: Robert Anthony Luciano, Jr., Reno, NV (US); Robert Steven Anderson, Reno, NV (US); Russell Tower Bradford, Incline Village, NV (US); Charles Theodore Schreiber, Reno, NV (US)

(73) Assignee: Edge Technology, Reno, NV (US)

( * ) Notice: Subject to any disclaimer, the term of this patent is extended or adjusted under 35 U.S.C. 154(b) by 628 days.

(21) Appl. No.: 10/057,007

(22) Filed: Jan. 24, 2002

Related U.S. Application Data

(60) Provisional application No. 60/264,609, filed on Jan. 26, 2001.

(51) Int. Cl.
*G08B 23/00* (2006.01)

(52) U.S. Cl. ..... 340/323 R; 235/375; 273/317.2

(58) Field of Classification Search ..... 340/323 R
See application file for complete search history.

(56) References Cited

U.S. PATENT DOCUMENTS 5,114,155 A * 5/1992 Tillery et al. ..... 273/371
5,439,224 A * 8/1995 Bertoncino ..... 473/153
5,626,531 A * 5/1997 Little ..... 473/353
6,569,028 B1 * 5/2003 Nichols et al. ..... 473/192
6,607,123 B1 * 8/2003 Jollifee et al. ..... 235/375

* cited by examiner

*Primary Examiner*—Daniel Wu

*Assistant Examiner*—Travis Hunnings
(74) *Attorney, Agent, or Firm*—Michael A. Kerr; Virtual Legal, P.C.

(57) ABSTRACT

A new and useful golf range target and system is disclosed. The new target incorporates an area having a top surface that will guide a golf ball which hits the surface to a golf ball receiver. The target receiver includes an RFID reader and a GPS receiver, which, upon the passing of a golf ball through the receiver, reads the golf ball ID using an RFID tag in the golf ball, then sends that data along with GPS data back to a server. The target is designed to be mobile, or moveable, by range personnel. The server then stores the data, and makes calculations such as the distance the golf ball traveled, the point value of the target hit (if any), and related fun information. This enables players to get real-time feedback using the targets, and allows ranges to encourage range play by keeping scores, awarding prizes, etc., based on target hits and other criteria.

15 Claims, 4 Drawing Sheets

Golf Range System

Top View Of A Range Target With 4 Receivers

Perspective View
Of Range Target
With Single Receiver

Method Of Using
Golf Range Target System

ENHANCED GOLF RANGE PLAY USING RFID AND GPS

This application claims the benefit of the filing date of provisional application 60/264,609 which was filed on Jan. 26, 2001, entitled "Enhanced RFID-Based Golf Range Play and Management".

BACKGROUND OF THE INVENTION

1. Field of the Invention

This invention pertains generally to golfing ranges. More particularly, the present invention discloses a method and apparatus for providing players at a golf range significantly better ball placement feedback and providing golf gaming possibilities using targets with RFID readers, RFID tags embedded within the golf balls being used, and GPS data.

2. The Prior Art

Golf ranges have typical configurations, well-known to those that use them. There is an entry point, where the player purchases some quantity of balls from the range. There may be minor variances in the pay schedule (regular players, walk-ons, etc.) but buying the balls is the player's payment for using the range. The balls are typical golf balls, and are usually stored in baskets or in a large hopper which dispenses a number of balls on demand (similarly to a coin dispenser) into a basket. There is no individually assignable ID on a per golf ball basis. The player then takes the balls to the tee or matt area, and hits them out into the range until they are gone.

The range will have various markers for distance placed throughout the range. A player hits a ball, and follows it with their eyes (if they can). After the ball hits the ground, a player must do as best they can to make a visual estimate of the distance they hit the ball, using the nearest distance marker. That completes the play.

There is some variation to the standard golf ranges found in England. There, several installations have added permanent targets in parts of the range. These targets are designed similarly to skee-ball type targets—concentric rings, with drainage holes for the balls that enter the rings (the drainage holes are similar to the those found in the last hole of a miniature golf course, where the ball follows a drain permanently installed underground back to the register or cashier booth). The targets a typically made of cement with a fabric covering. In some installations, the golf balls have RFID tags in them, and the balls entering the drain in the concentric circles of the target are read as they roll through the drain pipe. This allows the range to keep "scores" as golfers hit balls into the rings.

The current range play options for golfers is quite limited. A golfer has a choice of a standard range with no feedback available to the golfer other than his or her own visual feedback, or, in the UK one can go to a range having permanently installed concentric ring targets. There is no flexibility for the players (golfers) or the ranges for any type of dynamic changes to the range set-up, and limited feedback is available to the golfers trying to improve their game.

BRIEF DESCRIPTION OF THE INVENTION

Referring to FIG. 1, there is shown a system that combines modern computers (100, 104, 110), golf balls containing RFID tags and at least one RFID reader device, a radio or other wireless medium distance means of interconnecting devices, GPS satellite location capability with a target (108) and the Internet. This enables a more flexible and dynamic range setup than previously possible.

One method of using the system follows:

(a) identify balls by electronically reading their ID tags;

(b) electronically associate the balls with a player who has an account on the site server computer;

(c) player hits, throws, or otherwise delivers balls to a target which is capable of channeling the ball to an electronic reader;

(d) as the ball passes within range of the reader, the identifier of the ball is read and transmitted to the site server computer;

(e) the site server computer scores the game based on a variety of rules that has the ability to vary from one form of game to the next;

(f) the score is recorded and associated with the player's account;

(g) points are accumulated and tabulated for presentation on an electronic scoreboard showing player rankings; and, (h) scores and rankings are also posted to an associated web site where visitors to the web site can view this information along with other data and instructions.

The system is not limited to the components mentioned nor are all components required for the system to be operational.

Referring to FIG. 2, there is shown a target comprising a drain that funnels balls to a ball reader device that is attached to a controller which sends the identified ball information and GPS location back to a server computer. The server computer is responsible for scoring the game and recording the results in a database. When balls are leased to players at a cashier station, the association of the ball(s) to the player is recorded for later use in scoring a game and applying the resulting score to the player's account. The scored information is posted to an off-premises Internet server where players and visitors can view player ranking, individual scores, as well as receive information on tournaments and other activities.

According to one embodiment, the system comprises a target, the target having one or more ball sensing/reader device which identifies a ball and when it arrives. In another embodiment, the target configuration and type of ball changes but the essential ingredients of the game remains the same.

The system further comprises a ball reader which is a device capable of reading an imbedded or otherwise attached identifier tag and electronically passing that data to a device controller. The device controller is an interface that inter-connects various electronic components at a target or other collection point. Examples of devices are a GPS receiver, the ball reader, ball sorting and dispensing mechanisms, and a RF radio or other wireless transceiver.

The wireless transceiver is a device capable of sending data to and receiving data and commands from one or more remote computers. There may also be a GPS (Global Positioning System) receiver capable of providing the location of a target or other component in electronic format to ensure that distance measurements, when required, are reasonably accurate. The site server may comprise one or more computers designed to collect and process game information, including but not limited to, sale or lease of balls to players, registration of players, game scoring, receipt and transmission of data from/to a central site and various reporting, administrative and configuration tasks. The site server maintains a local database of player information, play history, pre-identified ball inventory, and other information pertinent to the game.

There may also be a web server comprising a central server geared toward maintaining player data, player ranking and analysis, communication of information of concern and interest to players, and serving as a medium for running on-line contests and tournaments.

This invention can be used for any gaming venue where a ball or other object can be thrown, hit or otherwise delivered to a target and the benefits of electronic scoring are desirable. It is particularly valuable in situations where multiple players are aiming for the same target at or about the same time.

Examples games include throwing a football or baseball at one or more targets. Another example might include an indoor setting, such as a bar, where players throw tagged foam footballs at a target that are automatically scored. By linking establishments such as this, players could compete for standing with other players in different locations.

Batting cages with one or more targets might also benefit from this sort of scoring system, allowing players to improve the accuracy and distance of their batting.

In prior art implementations of the RFID readers themselves, existing reader coils have been placed to one side of the sphere or object to be read. In contrast, the present invention passes the sphere or object through the center of a reader coil, providing greater read integrity by surrounding the sphere with a field as opposed to radiating a field from just one side.

An embodiment is a reader that can read a RFID tag embedded in a golf ball as the ball is passed through the center of the reader coil. The challenges involved with reading a tag in a golf ball are especially demonstrative of the benefits of this design in that the tag inside a golf ball must be extremely small and the orientation of a ball (and therefore the RFID tag's antenna inside the ball) is more difficult to control that other form factors such as a credit card. The RFID tag's antenna orientation relative to the reading coil determines how well the RFID tag can be energized and read. This invention solves the criticality of the relative orientation between the tag's antenna and the reading coils by surrounding the RFID tag with a field. Rotating the ball minimally while it is within the coil insures a positive read.

Any object that cannot easily be forced into proper alignment with a unidirectional reader coil is a candidate for this approach. Any round ball such as a tennis ball, baseball, or golf ball is difficult to assure correct alignment and as such would benefit from this invention.

Prior art RFID tags used in identifying golf balls and other such object use RFID technology that operates in the 125–128 KHz range. This low frequency further adds to the criticality of the need for specific relative orientation between the RFID tag's antenna and the reader's antenna (coils). Further, this restricts reading operations to a singe object at a time.

The present invention uses high speed anti-collision RFID technology to identify golf balls or other objects (such as baseballs, footballs, and other moveable sporting objects). Under this arrangement, multiple balls can be read simultaneously. Additionally, individual RFID tag reading (and therefore individual ball identification) can be carried out at much greater speeds than the prior art technologies. This allows buckets of balls to be identified all at once without the need to physically separate them, or balls can be read passing a reader at free-fall speed while still obtaining a positive read of the identification tag. The object to be read need not be oriented in with as much specificity as that required under prior art readers, thus removing the need to manually force an object such as a ball to be specifically aligned to the reader. Examples of readers having anti-collision properties for use with the higher frequency RFID tags may be found in catalogs of Texas Instruments Incorporated, 12500 TI Boulevard, Dallas, Tex. 75243-4136.

Using the high frequency readers, even without special object handling equipment, about 30 RFID tags/second may be read simultaneously. That number may be increased, but increases reader cost. Thus, it is expected that public golf ranges would use a standard reader and simply limit multiple read situations to groups of 30 or so balls, such that if a player buys 60 balls, there is a slight perceptible delivery lag (but not much, on the order of a few seconds). In private clubs, where players are willing to pay for incremental convenience, the cost and number of their readers can be increased thereby providing what is essentially real-time ball delivery (no perceptual slow down in ball delivery due to the need to read the RFID tags in each ball).

An example method of use of the present invention for a golf driving range is described below:

a) using a high speed anti-collision RFID reader, a bucket of balls is read simultaneously to identify which balls are in the bucket;

b) a player is identified electronically and/or electronically associated with each ball in said bucket of balls; and, c) the player hits the balls at targets equipped with a tag reader on one or more scoring drains or ball gathering and guiding receivers, where the balls are guided into (or past) an RFID tag reader which passes data to a computer that collects and scores the target hit.

Another use of the anti-collision reader would be at the target ball receivers or drains, allowing multiple players to simultaneously aim for and hit the same target, by providing simultaneous read of multiple balls reaching the target at the same time.

DETAILED DESCRIPTION OF PREFERRED EMBODIMENTS

Figure 1:
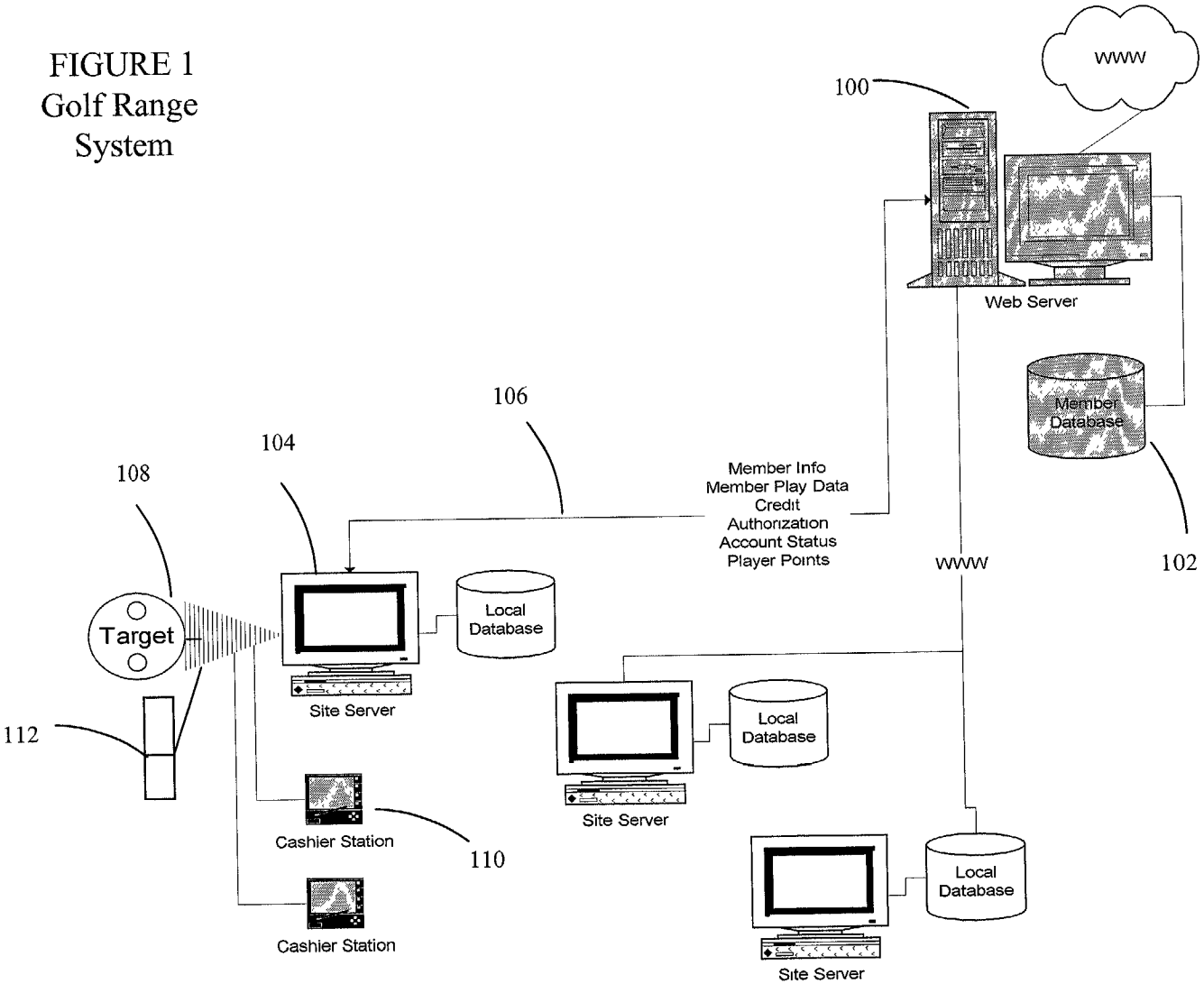
FIG. 1 is a block diagram of one golf system according to the present invention.

The description of the invention found in the present disclosure is illustrative of several embodiments, but is not limited to them. Other embodiments of the invention will be apparent to person having ordinary skill in the art and having the benefit of this disclosure.

Referring to the drawings, for illustrative purposes the present invention is shown embodied in FIGS. 1 through 4. It will be appreciated that the apparatus may vary as to configuration and as to details of the parts without departing from the inventive concepts disclosed herein. The method may vary as to details, partitioning, repetition, inclusion or exclusion of some of the described acts, and the order of the acts, without departing from the inventive concepts disclosed herein.

FIG. 1 shows a golfing system in accordance with the present invention. A player making use of the system will either provides their own balls having RFID tags therein, or more commonly will purchase balls to use on the range, those balls having RFID tags therein.

If the balls are owned by the player, there are two ways to enter them into the system. The first is to create a player account, intended to kept permanently on the range's database of players. The player will typically be issued a player's card, often in the form of a magnetic stripe card but including any type of readable media from which a player's ID may be read. Alternatively, the player may be issued a player ID in the form of a PIN. After creating the account, the player puts their balls in a ball RFID reader, and the ID of each ball is read, then that number is entered in a database having records with fields associated with the player for ball IDs. Depending on the size of the range, the database may be implemented in a smaller package such as Microsoft's Access running on Windows or NT, or for larger ranges an Oracle database running on Linux. Whatever database is chosen, the ball IDs are associated with the player ID. The second method does not require a player ID; the balls are simply read by a reader and grouped by assigning an anonymous player ID, or grouped by allowing a ball ID to be used as a lookup by the database into a set of balls defined as a group. The player now enters the tee area of the range.

If a player purchases the balls at the range, there will typically be a large ball hopper containing many golf balls, or there may be buckets of balls already dispensed. In either case, these balls will then be passed through a reader which will associate the ball ID numbers with either an existing player account, or a temporary (anonymous) player account. If the account is temporary, the player may be issued a paper voucher with a temporary ID on it, having perhaps a barcode of the temporary ID as well as human-readable indicia (makes it easier for the player to continue playing in one session by re-using the voucher). Alternatively, the player may simply be told an ID number, or may be told nothing. In the last case, the database will simply receive the ball ID data from the reader, and store the IDs as a group, and further in a manner such that receiving one of the ball IDs from the range reader allows lookup by that ball ID into the temporary group. This will work OK for small ranges, but would not be an ideal solution for larger ranges.

The result of any of these ball ID data storage methods is that there will be a set of ball IDs associated into a group, and most after further associated with a player ID (either a temporary or permanent ID). This initial reader is shown generally as reader 112 in FIG. 1, where it reads the balls and sends the ball data (in whatever manner it is operably communicating, hardwire port, networked, RF, IR, etc.) to Server 104. Reader 112 is shown as having two sections, which represents two local readers. The other reader is at the tee area, reading balls as they are hit; alternatively, the reader in the tee area may further include a time stamp when the ball passes a certain point (usually interrupting a beam, but similar any detection method will work).

In this particular embodiment, the player database is shown on server 100, which is separate from server 104. In smaller establishments this will typically be the same physical computer. However, for larger establishments spread over a wide physical area (or having multiple sites), there will be local servers such as server 104 which will relay the data to a central database 102 on central server 100, which may also be (in one embodiment) a WWW server. Connection 106 is any operable connection, which includes any type of LAN or WAN, including (although not preferred) a session-based dial-up type connection.

Cashier stations 110 will be connected to the local server in a direct manner (LAN, direct ports, wireless RF), or through the WWW to central server 100. They are enabled such that any paying actions are relayed to the station by the server to which it is connected. Paying actions include, but are not limited to, ball purchases, tee fees, or payouts from making a predetermined amount of points on the targets (if the range is set up to associate points with specified target receivers, which is expected to be typical).

Server 100 also enables players to reach the server from a home machine via the WWW, which will show them either their own player account, or will show the results of any ongoing tournaments associated with hitting the targets.

Figure 2:
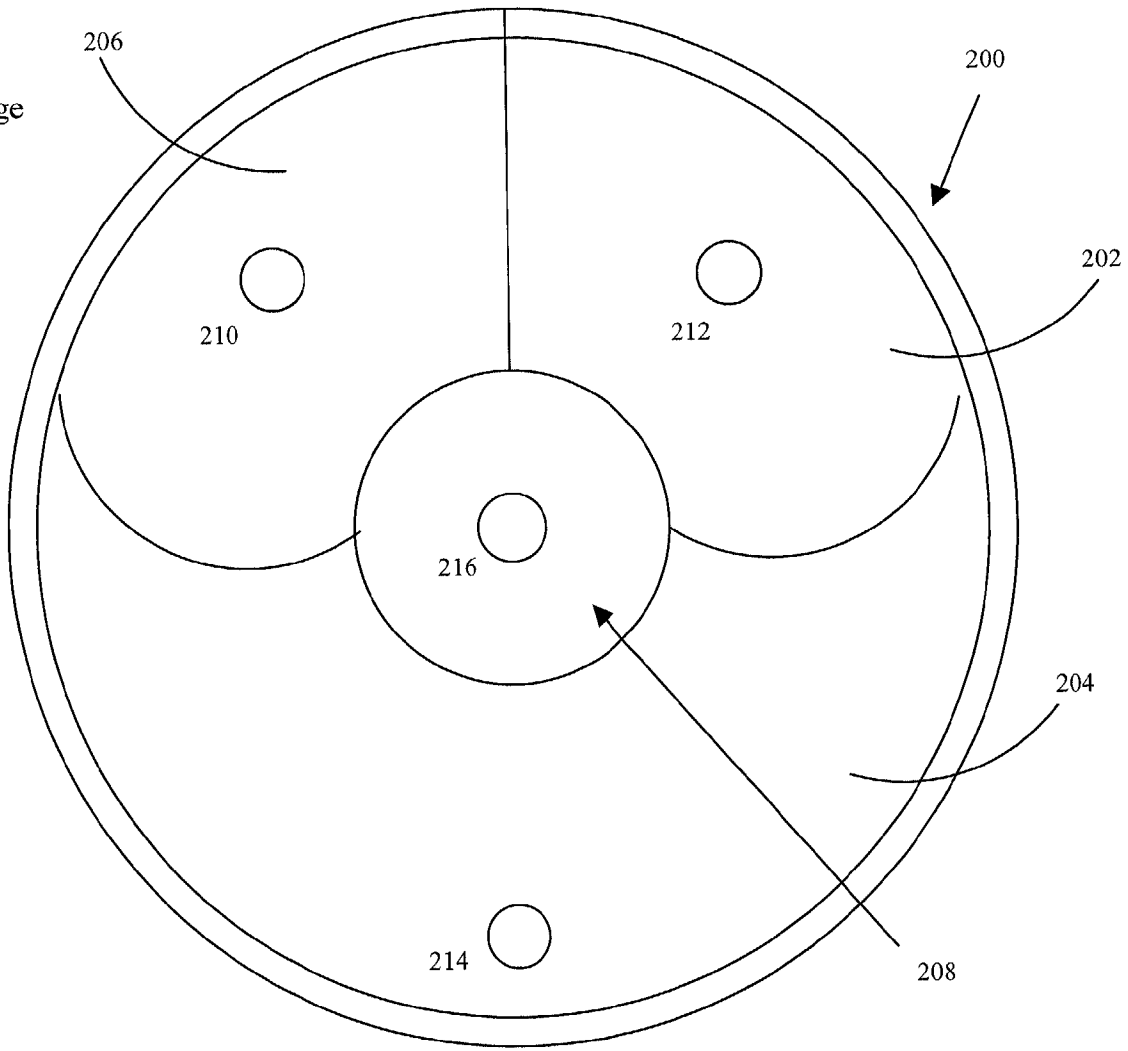
FIG. 2 is a top view a target in accordance with the present invention.

FIG. 2 shows a top view of one embodiment of a target. The target top 200 has four areas, area 202, area 204, area 206, and central area 208. Each of these areas defines a location such that if a ball lands anywhere within the area, it will roll to a receptacle in that area. For example, if a ball lands anywhere in area 208, it will roll into receptacle 216. Area 206 has receptacle 210, 202 has receptacle 212, and 204 has receptacle 214. Each area will typically have different point values (scoring values) associating with it. In this case, area 208 has the highest value and area 204 (the "catch-all" area) has the lowest. The ball, upon entering any of the receptacles, will have its RFID read by an RFID reader placed inside the receptacle.

A novel and superior reader configuration is the preferred embodiment inside the receptacles, where the reader coils are wrapped around the tube in which the ball rolls. This allows faster, more accurate signal pickup than having the reader coils beside and outside the area in which the ball rolls, although for some less expensive implementations the prior-art style external readers may be used.

Figure 3:
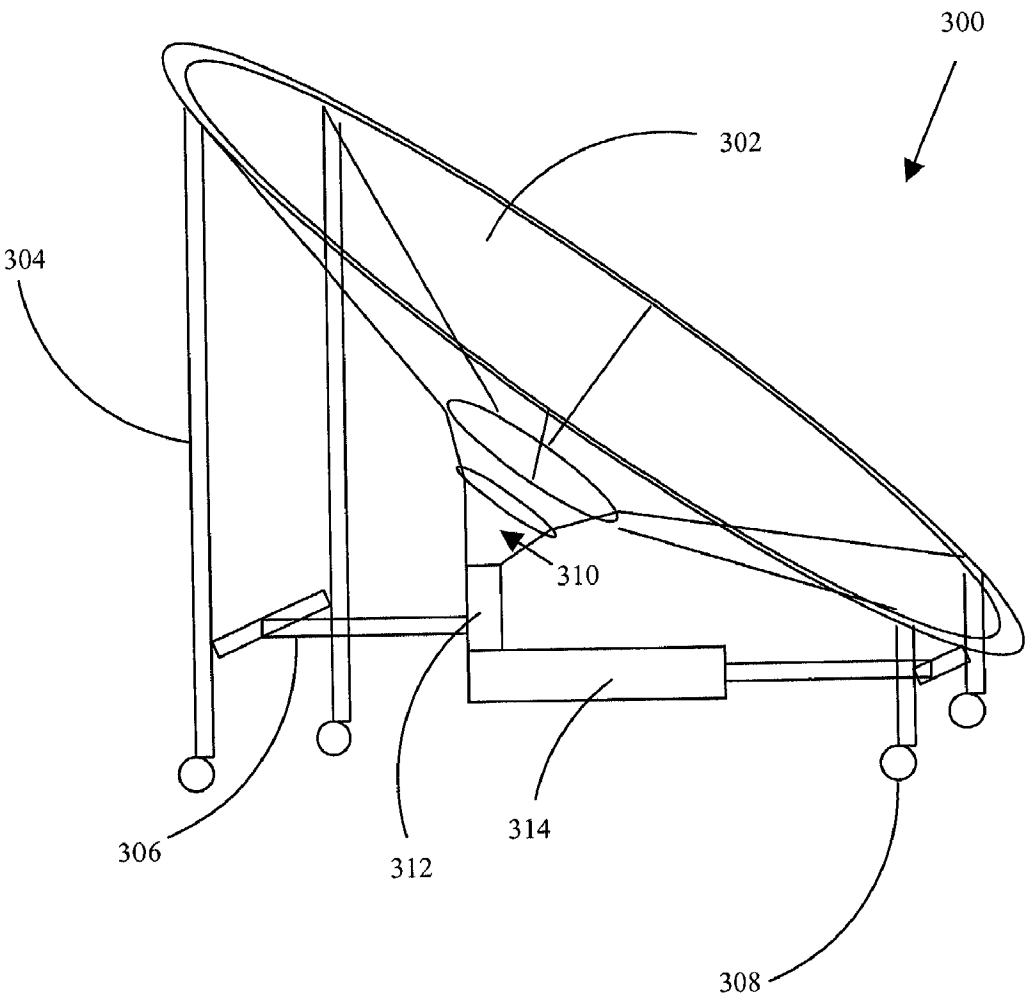
FIG. 3 is a perspective view of a target in accordance with the present invention.
Figure 3:
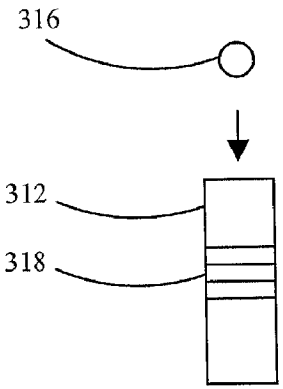

FIG. 3 shows a perspective view of a target according to the present invention. The entire target, 300, is movable. There is a central net area 302 which guides a ball landing within it to receiver or receptacle (both names refer to the same component) 310. Receiver 310 guides the ball into reader/transmitter 312. In one embodiment, reader/transmitter 312 includes a GPS receiver as well as a reader for the golf balls. However, the GPS receiver may be in a separate physical unit on the target unit if so desired. As is known about GPs receivers, a GPS receiver receives signals from GPS satellites and, from the signals, determines its location (latitude, longitude, altitude) within a few feet (the accuracy will depend on the receiver).

Upon receiving and reading a golf ball, reader/transmitter 312 further takes a readout from the GPS receiver. The data is now sent to the closest server, as was shown in FIG. 1. This data may further include time, or, the time may be attached by the server upon receipt of the data. The balls are then collected in collector 314, to be retrieved by range personnel. Note that reader/transmitter 312 and collector 314 are attached via supports 306 to target support legs 304. The attachment may of any type that allows the unit top be moved as a whole. Further shown are caster wheels 308, allowing the entire target to be rolled. Note, however, that the concept of "mobility" as used herein does not require wheeled mobility. For example, in larger ranges it may be preferable to have the legs 304 be flat on the bottom, and the entire unit is picked up using a lull with tangs, a fork lift, or similar mechanical lifting mechanism. Further, reader/transmitter 312 and collector 314 could be designed to sit on the ground. In such cases the target, when moved, would be moved in two (or more) pieces; the top target mesh or net (which can be made very light, and movable by 2 to 4 people), and the receiver/reader/transmitter/collector, which may be heavier than the top target portion, but movable when separated from the rest of the target. It would then be placed under the target top in the target's new position, and operably connected to receiver 310 (310 may have be a flexible connector to enable easy connections, for example).

The key property to being mobile is that it is not permanently installed in one location. This is direct contrast to permanent target installations which may be found in the UK, where there are golf ranges that have what appear to be skee-ball-like targets permanently installed in the middle of some golf range. These permanent targets are made of concrete and their associated drains or ball receivers are permanently installed underground in the range.

Mobility for smaller target units means they can be moved as a single assembled piece by several people without much difficulty; mobility for larger target units (used at larger ranges) may require separation into smaller subcomponents, moved as pieces, and then reassembled at the new location. It is expected that for larger targets, the target top would be one piece, the multiple ball receivers and reader/transmitters associated with each ball receiver would be another set of separable components, and the supporting legs be a third set of separable components. For larger targets with multiple ball receivers, a preferred embodiment will have a GPS receiver as part of each reader/transmitter.

Also shown in FIG. 3 is a close-up of reader/transmitter 312. Golf ball 316 enters through the entry portion of the central guide tube of 312, passing through a set of coils 318 that the reader energizes and uses to energize the RFID tag inside the golf ball 312, the RFID tag returning a unique ID (a unique number identifying each particular golf ball, creating a one-to-one mapping between each golf ball and a unique ID number), the golf ball then exits the reader via the exit end of the guide tube. The central portion, shown here as a tube used to guide a golf ball, need not be a tube—other embodiments include a simple inclined ramp that guides the ball past a standard RFID reader to one side of the ball. Shown is a preferred embodiment of the reader, where the antennae coil is wrapped 318 around the guide tube portion of reader/transmitter 312. This enables faster reading with less directional dependency of the ball.

Figure 4:
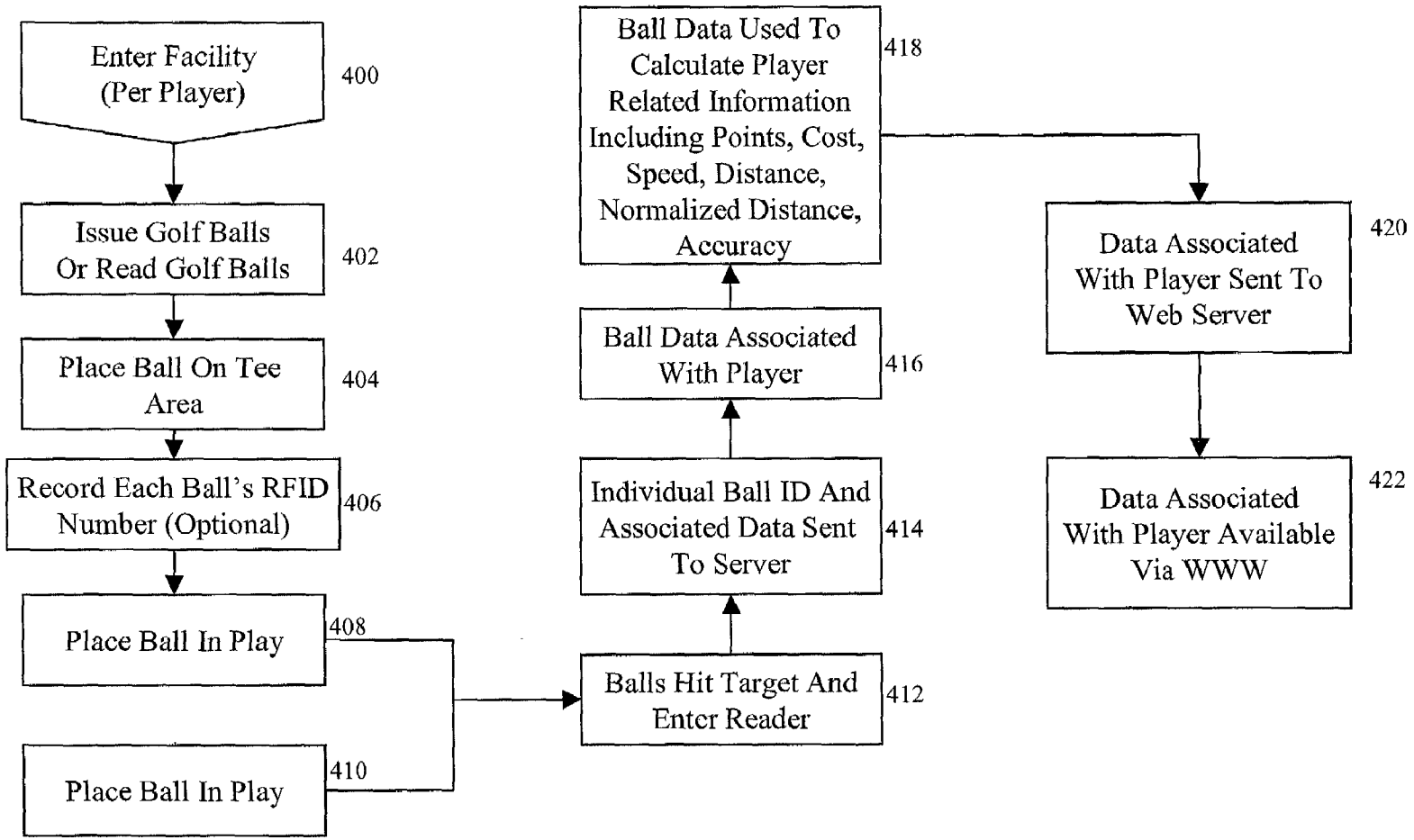
FIG. 4 is a flow diagram showing a method of using a golfing system in accordance with the present invention.

FIG. 4 shows one method of use of the present invention. Staring at entry point 400, a player enters the golf range (facilities). At this point in the flow diagram, the actions correspond to a single player. However, these actions will be repeated for all players.

Entry point 400 is left and block 402 entered. The actions corresponding to block 402 are those involved with reading the IDs of the balls that the player will use for this golf session, and saving the ball ID information in a retrievable manner in a database. If a player has no player ID, or the range does not use player IDs, then one of two things happens. The ball IDs are read and entered into a database associated with a temporary player ID, or in a manner such that the ball IDs can be used to find the temporary group of balls (i.e., a hashing function into a table of active ball IDs). Block 402 is left and block 404 entered.

The actions corresponding to block 404 are those associated with playing each ball of the group just read. Play consists of placing a ball on a tee area (matt, driving area, etc.), and hitting it. There may be one of several consequences to this action by the player; the consequences will depend on the range. In upper-end ranges, the ball ID will be read at the tee area (tracking and timing information), and the ball will trip a sensor upon being hit which sends timing data (or, sends a signal for a server to record its own time and associate it with the hit event, depending on the operable connection between a local server and the tee area). This will later be combined with the data from the target and used to determine average speed, etc. Alternatively, there may be no sensors in this (for smaller ranges with less expensive infrastructure). If there are no sensors, there will be less tracking (and less ability to detect cheating) per ball, and less data such as velocity available to the player, but the system will be enabled to keep scores based on target hits. In a preferred embodiment, at a minimum there will be a GPS receiver reading corresponding to the tee area (or, a plurality of tee areas) stored in a known retrievable location on at least one server to enabled distance calculations, even when there are no active sensors in the tee area. The ball is now in play (on its way down the range), so block 406 is left and block 408 is entered.

Blocks 408 and 410 correspond to balls in play originating from any and all players currently on the range. There may be any number of equivalent blocks between 408 and 410 feeding block 412, as shown by the dotted lines between blocks 408 and 410. All those blocks feed into block 412. Block 412 is now entered.

The actions corresponding to block 412 are the balls hitting someplace on the target surface and entering a receiver (note: some targets may have only one receiver, others may have many). As each ball enters a receiver, its ID is read by the receiver. Leaving block 412 and entering block 414, the receiver then transmits the ball ID and any related data (GPS position, optionally time of the event) to a local server. Block 414 is left and block 416 entered.

The actions corresponding to block 416 take place in the server. The data sent by the receiver is associated with a player (if a player ID is used), or, is associated with a "ball group" if no player ID is used. If the server is a local server and there is a central server, that data is then relayed to the central server. Otherwise, all the following actions take place on the local server. Block 416 is left and block 418 is entered.

The actions corresponding to block 418 are to take any and all data associated with this ball ID and player ID (if any), store the information, and make calculations. At a minimum this includes the target receiver hit, the GPS data associated with the receiver, and the ball ID. If there is a player ID and if there were sensors at the tee area, that data is also available for use in calculate.

The calculations and data are then used to determine any point or prize value for the target and receiver that was hit, target distance (the distance the ball traveled, using the GPS data), and costs associated with the play (for example, rather than buying a bucket of balls, this system allows a player to be charged on a per target hit basis, which has advantages to both the player and the range). If there are sensors in the tee area, an average ball speed could be calculated. Additional calculations could be a normalized distance calculation (possible because the altitude is known, allowing for the air density to be compensated for in a normalized distance calculation—very helpful for comparing driving results on different gold courses) and an accuracy calculation (if the targets being hit are similar to that shown in FIG. 2, where the center is the best target result). These calculations are then stored with the player ID and other data, or the ball group data. Box 418 is completed; the process may end here or, in embodiments having a WWW server, box 420 is entered.

The actions corresponding to box 420 include incorporating the data into the database used by the WWW server, enabling the results to be shown on the web. Box 420 is left and box 422 is entered. The actions corresponding to box 422 are to make the results (all the data collected and stored) available to people who log into the WWW server available on the web. This may be on an individual basis, where a player retrieves only her or his own data, or may display the results of ongoing tournament, points competition, promotional play, and other results desired to be displayed by the range.

The present invention has been partially described using a flow diagram. As will be understood by a person of ordinary skill in the art and with the benefit of the present disclosure, steps described in the flow diagram can vary as to order, content, allocation of resources between steps, times repeated, and similar variations while staying fully within the inventive concepts disclosed herein.

Accordingly, it will be seen that this invention provides a system and method for providing novel and useful real-time and on-line player feedback and excitement at a golf range. Although the description above contains certain specificity, the described embodiments should not be construed indicating the scope of the invention; the descriptions given are providing an illustration of certain preferred embodiments of the invention. The scope of this invention is determined by the appended claims and their legal equivalents.

The invention claimed is:

1. A golf range system comprising:

a target, said target having a top surface and at least one golf ball receiver, said golf ball receiver configured to have a first opening at said top surface of said target and a second opening, said target further comprising a target reader/transmitter, said target reader/transmitter further comprising an entry portion, a guide portion, an exit portion, and where said second opening of said golf ball receiver is configured to allow operable connection to said entry portion, a first RFID reader configured such that a golf ball, upon entering said entry portion, will follow said guide portion past said first RFID reader in a readable manner and then exit via said exit portion, a GPS receiver operably connected to said reader/transmitter such that data from said GPS receiver is transmittable to a server, and where said target reader/transmitter is operable for communication with at least one server, said target being movable;

a second RFID reader configured to read golf ball RFID tags and extract golf ball IDs thereby and further configured to be in operable communications with at least one server;

a server operable for communication with said at least one target reader/transmitter and said second RFID reader and configured to make at least one calculation regarding golf ball and player data using data received by said server from at least one of: said target reader/transmitter; or, said second RFID reader, said server further comprising a database;

said database configured to retrievably hold golf ball IDs in associated with one of: other golf ball IDs; or, at least one player ID, and further configured to hold data sent by said target reader/transmitter and said second RFID reader, and store said calculated golf ball and player data, in a manner retrievable by one of: a player ID; or, a golf ball ID.

2. The golf range system of claim 1 where said first RFID reader is configured such that its antenna coils are wrapped in a tubular manner around said central guide.

3. The golf ball range system of claim 1 where said second RFID reader is configured such that its antenna coils are wrapped in a tubular manner around a guide, said guide configured to enable a golf ball to pass through said tubular antenna coils.

4. The golf range system of claim 1 further comprising a sensor located near at least one tee-off area, said sensor configured to detect a golf ball that is one of: placed on the tee-off area; hit from the tee-off area; or, both placed on, and hit from, the tee-off area; and is further configured to transmit data about said detected golf ball to a server.

5. The golf range system of claim 1 further comprising a plurality of servers, where said plurality of servers are in operable communication with each other, and where one of said plurality of servers further comprises a database, said database configured for player accounts, and further configured to hold one of: golf target data, golf ball ID data, detected golf ball data; or, golf target data and golf ball ID data and detected golf ball data in a manner associated with a player account.

6. The golf range system of claim 1 further comprising a plurality of servers, where said plurality of servers are in operable communication with each other, and where one of said plurality of servers further comprises a database, said database configured for storing data in a manner retrievable using golf ball IDs, and further configured to hold one of: golf target data, a plurality of golf ball IDs, detected golf ball data; or, golf target data and golf ball ID data and detected golf ball data in a manner associated with a golf ball ID.

7. The golf range system of claim 1 where said at least one server is also configured to be an internet server, enabled to allow logged in users to retrieve one of: personal golf game data; a plurality of player's of golf game data; or, both personal and a plurality of player's golf game data.

8. A method of using a golf range system comprising:

providing the golf range system having a target, the target having at least one golf ball receiver and at least one RFID and GPS reader/transmitter in communication with at least one server:

entering the golf range;

providing a set of golf balls having RFIDs therein, where said set of golf balls comprises one or more golf balls;

using a range entry golf ball RFID reader to provide a set of golf ball IDs corresponding to said set of golf balls in a one-to-one manner;

storing said set of golf ball IDs on a database on said server;

associating said set of golf ball IDs with an account on said database;

hitting said golf balls from a tee-off area towards said target;

gathering data on hits on any said target using data from said RFID and GPS reader/transmitter;

sending said data to said server;

providing access to said account data about said golf ball hits and any other data collected pursuant to using said set of golf balls.

9. The method of claim 8 where said providing a set of golf balls is a set of golf balls purchased for play by a player at a range cashier's station.

10. The method of claim 8 where said providing a set of golf balls is a set of golf balls owned by a player, and brought to the range by said player.

11. The method of claim 8 where said associating said set of golf ball IDs with an account further comprises associating said set of golf ball IDs with a specific player account.

12. The method of claim 8 where said associating said set of golf ball IDs with an account further comprises associating said set of golf ball IDs with an anonymous player account.

13. The method of claim 8 where said associating said set of golf ball IDs with an account further comprises associating said set of golf ball IDs into a group, said group being accessible using any one of the golf ball IDs contained in the group.

14. The method of claim 8 where said gathering data on any hits on any target further comprises:

providing a plurality of targets;

recording data on any ball from said set of balls that reaches any target;

sending said gathered data to a server;

gathering all sent data in said database;

providing said data to any authorized user, player, or program running on said server.

15. A method of charging players using a golf range system comprising:

providing the golf range system with a target, the target having at least one golf ball receiver and at least one RFID and GPS reader/transmitter in communication with at least one server comprising:

reading a set of golf balls at a range entry golf ball RFID reader;

associating a player with said read set of golf balls;

allowing said player to go to a tee-off area;

recording in a database output from said sensor each time a golf ball is placed in said tee-off area;

totaling the number of golf balls said player places in said tee-off area in a periodic manner; and, billing said player based on the number of golf balls that have been placed on the tee-off area.

* * * * *